US005509871A

United States Patent [19]

Giovanni

[11] Patent Number: 5,509,871

[45] Date of Patent: Apr. 23, 1996

[54] MECHANICAL SURFBOARD SIMULATOR

[76] Inventor: Chris San Giovanni, 1016 Banyan Way, Pacifica, Calif. 94044

[21] Appl. No.: 333,285

[22] Filed: Nov. 2, 1994

[51] Int. Cl.[6] ..... A63B 69/18

[52] U.S. Cl. ..... 482/51; 482/30; 482/34

[58] Field of Search ..... 482/30, 34, 51, 482/148, 146, 71, 79, 80, 77, 111; 434/258

[56] References Cited

U.S. PATENT DOCUMENTS 822,448 6/1906 Hanson ..... 482/77
4,645,197 2/1987 McFee ..... 482/111
4,653,748 3/1987 Seel et al. ..... 482/146
4,966,364 10/1990 Eggenberger ..... 482/146
5,062,629 11/1991 Vaughan ..... 482/51

*Primary Examiner*—Stephen R. Crow
*Attorney, Agent, or Firm*—Bielen, Peterson & Lampe

[57] ABSTRACT

A surfboard simulator device for training users in the sport of surfing, the device including a stable base platform and an elevated surfboard unit that is interconnected to the base platform by a spring assembly that provides limited articulation to the surfboard unit to allow fore and aft pitch and side-to-side roll with a bias providing greater side-to-side roll than fore and aft pitch.

8 Claims, 1 Drawing Sheet

MECHANICAL SURFBOARD SIMULATOR

BACKGROUND OF THE INVENTION

This invention relates to a mechanical simulator for the sports activity of surfing. The sports activity of board surfing requires a great deal of balance. Typically, one of the most difficult aspects of the sport is to quickly go from a prone paddling position on the surfboard to an upright standing position. In the water, a surfboard has a limited stability that is generated by the forward motion of the board in the water under influence of one or more fins on the underside of the surfboard. In order to construct a simulator device that closely approximates the stability of the board, provision must be made for a difference in the stability in the fore and aft direction compared with the starboard and port, or side-to-side direction.

Although certain electro-mechanical arcade systems have been developed to generate a simulated activity of surfing using audio and visual aids in addition to dynamic motion, these devices are extremely expensive and actively generate motion in the board that is coordinated with a visual screen showing an ocean wave scene. These devices are largely used for entertainment and not for training.

The mechanical simulator device of this invention is a training device designed for both the beginning surfer and the experienced surfer. The beginning surfer must develop the balance necessary to stand on an unstable surfboard. The mechanical training device will provide him with the repetitive experience of standing on the board. This developed experience on land greatly shortens the time taken to acquire this experience in the water under actual conditions. Similarly, the mechanical simulator device is devised to maintain the skills of intermediate and advanced surfers, particularly during periods when the actual surfing experience is not available.

Surfing is a sport that requires both endurance and agility. A typical outing lasts between one and three hours. During this period of time, substantial energy is expended in positioning the surfer at the appropriate place in the water to optimally catch waves. Of the time spent surfing, only a small fraction involves the rapid paddling in front of a potential wave and the motion of going from the prone paddling position to the standing, wave riding position. Furthermore, even if the surfer is successful in the transition from the prone position to the standing position, a period of time in which he can maintain his balance and "ride the wave" is brief. Often, the duration of the ride for the beginner surfer is simply the time between the surfer arriving at an out-of-balance standing position, to the time that his lack of balance causes a fall. In this situation, the surfer has not yet caught his balance. The time between being in balanced control in a prone position and balanced control in a standing position is a brief, but critical period of time. It is this critical time period that is most difficult for a beginner surfer to master. The simulator device of this invention enables the surfer to experience this action over and over until he or she becomes comfortable with the action and can duplicate the experience under real conditions in the water.

SUMMARY OF THE INVENTION

The mechanical simulator device of this invention is designed and constructed to provide a realistic training experience for the sport of surfing. The mechanical simulator device is constructed with a base platform having a plurality of spaced spring members that connect the base member to an elevated surfboard unit. Preferably, the surfboard unit includes an actual surfboard connected to a support platform that is in turn connected to the spring members of the base platform. To minimize injury, the surfboard may comprise a foam composition board that provides a soft impact surface would minimize injury in the event that the user fell against the board during use. The apparatus is designed such that the base platform can be covered by a padding means such as a large foam pad. Alternately, if the training device is used at the beach, the base platform is covered with approximately six inches or more of loose sand to prevent direct contact with the base platform in the event a user falls from the surfboard.

In the preferred embodiment, two spring members are utilized and spatially positioned on the platform in alignment with the length of the surfboard. Furthermore, the spring members preferably include a pneumatic piston assembly that provides a variable damping effect to the spring members, thereby allowing the stability of the surfboard to be adjusted. For example, where the user is first attempting to balance on the surfboard, the pneumatic pistons may be adjusted such that there is a stiffening effect to the interconnection of the surfboard unit and base platform. In this manner, additional stability is provided to the surfboard allowing the user the experience of standing from a prone position on the surfboard. With the pneumatic piston assemblies removed or adjusted to their least effectual operation, the user may experience difficulty maintaining a prone position on the surfboard. Therefore, during initial training sessions for a beginner, the simulator device is adjusted such that the surfboard unit is relatively stable. As the user gains experience in using the stable unit, adjustments can be made to make the surfboard unit increasingly unstable to better approximate actual conditions of a surfboard in water. Because the user can make numerous attempts to rise from the prone position to the standing position within a short period of time, a great deal of experience is gained in balance and movement. Furthermore, the land based simulator device enables an instructor to closely watch and monitor the transition movement of the learner from lying on the board to standing, which is sometime difficult to accomplish in the water.

Just as the experience of a surfer on a surfboard in the water, the mechanical simulator offers little resistance to side-to-side rolling motion. The design, therefore, requires a mechanism that provides greater stability fore and aft than side-to-side. The use of two spaced spring members provides this type of stability most effectively at least expense. The use of stabilizers such as the pneumatic shock absorber is an added feature that allows for adjustment of the stability, which is particularly important where the device is used for training beginners. These and other features are described in greater detail in the Detailed Description of the Preferred Embodiments that follows.

DETAILED DESCRIPTION OF THE PREFERRED EMBODIMENTS

Figure 1:
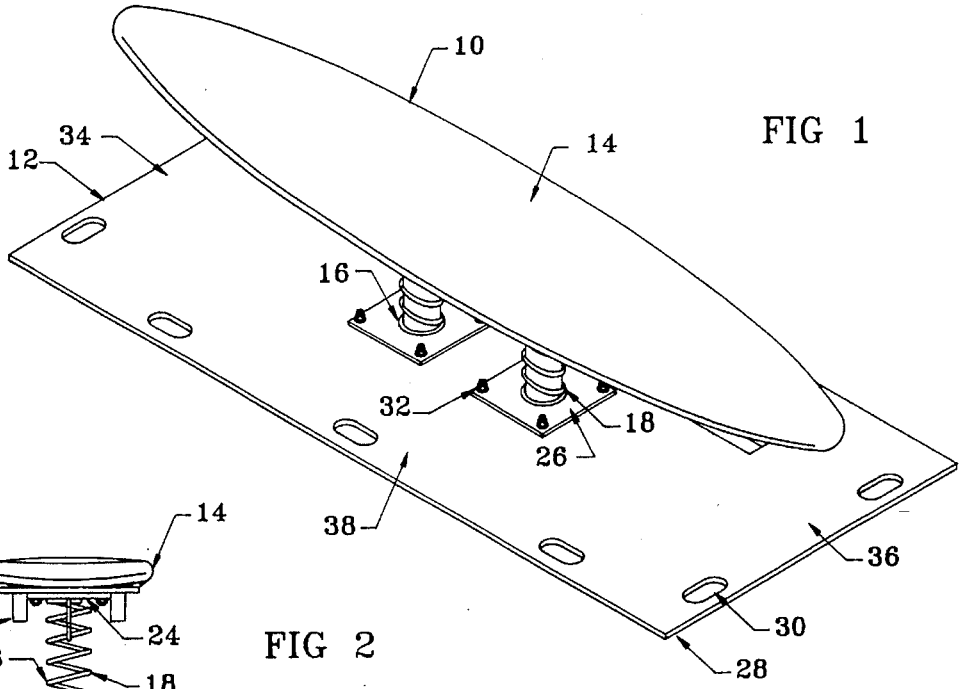
FIG. 1 is a side perspective view of a first embodiment of the surfboard simulator device.

The mechanical surfboard simulator device of this invention is shown in FIG. 1 and designated generally by the reference numeral 10. The surfboard simulator device 10 includes a base platform 12, a surfboard unit 14 and an interconnecting articulating mechanism 16. In the preferred embodiments of this invention, the articulating mechanism comprises a spring assembly 18. In the embodiment of FIG. 1, the spring assembly 18 comprises spring members, including a first coil spring 20 and a second coil spring 22 having top and bottom end plates 24 and 26 that are welded to the ends of the coil springs to provide a support base for connecting to the base platform 12. The base platform 12 comprises a flat sheet of one inch plywood with a perimeter having beveled rounded edges 28 and a series of conveniently located hand grip holes 30 around the perimeter. The hand grip holes 30 enable the surfboard simulator device 10 to be easily carried for transport to a practice area or to a beach site where the simulator device may be used in a training program for beginning surfers. The base platform 12 is sufficiently large to provide a stable base for the apparatus. Conveniently, a 4' by 8' sheet of plywood has been found to provide the necessary stability for a "long board" having a length of approximately 10'. Where the surfboard simulator device is to be permanently located, the base platform can be a ground fixture, for example, a concrete floor with embedded mounting bolts for securing the mounting plates 24. The bottom mounting plates 24 in the preferred embodiment have a topside and an underside, with the underside of each mounting plate secured to the top surface of the base platform 12 by carriage bolt fasteners 32. The mounted coil springs 20 and 22 are centered on the base platform 12 and spaced such that the base platform is divided into substantially three equal sections, end sections 34 and 36 and a central section 38. This approximate spacing positions the spring assembly in a central portion of the surfboard and evenly distributes the forces from the elevated surfboard unit 14 to the base platform 12 in a relatively uniform manner. Additionally, the spaced positioning of the spring members provides the necessary bias to the articulation, such that the fore and aft pitch is substantially tempered compared to the side-to-side roll. This is an important Feature and enables the simply constructed surfboard simulator device of FIG. 10 to approximate the stability of an actual surfboard in aquatic conditions. The surfboard 44 is elongated with a longitudinal axis and connected to the base platform 12 to allow the fore and aft pitch along the axis and side-to-side roll transverse to the axis.

The surfboard unit 14 is an assembly of a surfboard 44 and a support platform 40 having stringers or runners 42 to provide a rigidity to the support platform. The surfboard is elongated and the spring assembly 18 is positioned along the longitudinal axis of the surfboard. Where the surfboard simulator device is utilized for training beginning surfers as well as for use by experienced surfers, it is preferred that the surfboard 44 be comprised of a foam board material. In this manner, a user falling against the board is less likely to incur any injury from the surfboard. Where the surfboard simulator device is utilized simply for maintaining skills, a conventional foam-core, fiberglass board can be utilized.

The surfboard 44 has a topside and an underside and the underside of the surfboard 44 is attached to the support platform 40 by an adhesive, and the support platform is in turn attached to the spring assembly. Because of the curvature to the surfboard 44, the space between the raised tip 46 of the surfboard and the end of the support platform 40 is filled with a light-weight styrofoam filler plug 47. In this manner, the weight of a user on the nose of the surfboard 44 will not damage or break the surfboard. Similarly, the space between the tail 48 and the support platform 40 is filled with a foam material plug 49. The surfboard 44 includes a fin 50 so that the surfboard unit 14 has a realistic appearance. The surfboard unit 14 is connected to the articulating mechanism 16 by fastening the support plates 26 to the support platform 40 with carriage bolt fasteners 32. In the simple embodiment of the simulator device as shown in FIG. 1, the coil springs 20 and 22 provide the sole interconnection between the surfboard unit 18 and the base platform 12. Therefore, the stiffness of the springs are carefully selected to provide a stability to the surfboard unit 14 that accurately simulates a surfboard in water. Different springs may be provided for users with different experience and weight. For example, highly reactive springs with relatively low spring constants may be required for a lightweight young person with experience who utilizes the simulator device to maintain his skills during the period he is unable to experience actual surfing.

Figure 3:
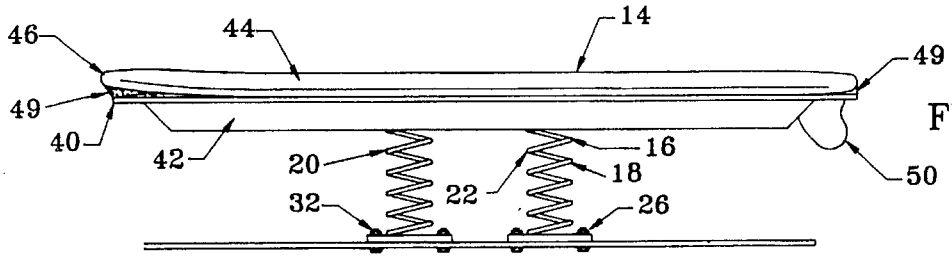
FIG. 3 is a side perspective view of a second embodiment of the surfboard simulator device.
Figure 4:
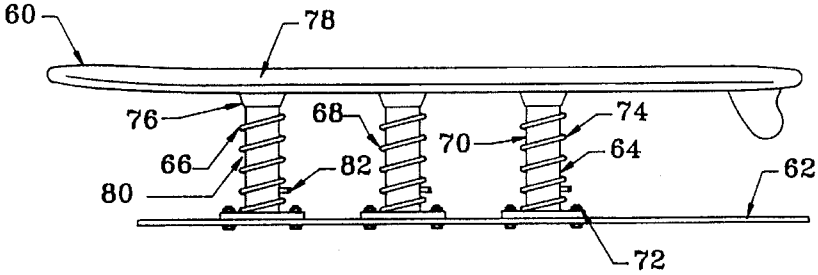
FIG. 4 is a side perspective view of a third embodiment of the surfboard simulator device.

As shown in the schematic view of FIG. 3, a modified embodiment of the surfboards simulator device is shown and designated generally by the reference numeral 60. In the modified embodiment 60, a base platform 62 includes a spring mechanism 64 having three coil spring assemblies 66, 68 and 70 spaced along the center line of the base platform 12. The coil spring assemblies 66, 68 and 70 include mounting plates 72 for securing the assemblies to the base platform 62. In addition, each coil spring assembly includes a coil spring 74 and a disk plug 76 that is embedded in a fiberglass board 78. The use of three spring assemblies provides a more distributed support when using a direct connection to a surfboard 78 that omits a support platform and must be essentially self-supporting.

Figure 2:
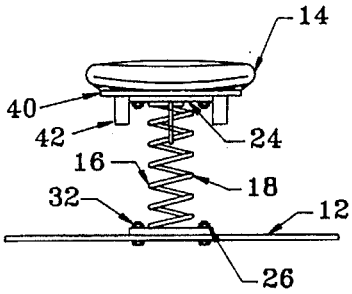
FIG. 2 is an end elevational view of the simulator device of FIG. 1.

As an added feature, each of the coil assemblies 66, 68 and 70 includes a pneumatic shock absorber 80 located within the coil of the coil spring of each spring assembly with an easily accessible air valve 82 for removing or adding air to the shock absorber 80. Adding or removing air from the shock absorber 80 adjusts the dampening effect of the shock absorber in the coil spring assembly. In this manner, the relative stiffness of the board can be changed depending on the experience of the user or the weight of the user. It is to be understood that certain features of the modified embodiment may be included in the primary embodiment of FIGS. 1 and 2. For example, an additional coil spring or shock absorbers may be added to the embodiment shown in FIGS. 1 and 2 without departing from the scope of this invention.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A surfboard simulator device for training users in the sport of surfing comprising:

a base adapted for placement on a ground surface;

a surfboard unit including an elongated surfboard, the surfboard unit having a topside and an underside, wherein the topside has an area equivalent to an actual surfboard with a size sufficient to allow placement and free movement of a user's feet;

an interconnection means for interconnecting the underside of the surfboard unit with the base wherein the interconnection means has mechanical means for allowing limited articulation between the surfboard unit and the base, and wherein the mechanical means for allowing limited articulation comprises a spring assembly, wherein the surfboard has a longitudinal axis and the spring assembly has bias means for providing greater stability for fore and aft pitch along the longitudinal axis of the surfboard than side-to-side roll transverse to the axis of the surfboard, wherein the bias means has a force of bias on the longitudinal axis of the surfboard comparatively greater than the bias transverse to the axis of the surfboard that simulates the degree of bias of an actual surfboard in aquatic conditions.

2. The surfboard simulator device of claim 1 wherein the surfboard has a center portion wherein the spring assembly comprises first and second displaced coil spring members positioned substantially at the center portion of the surfboard, wherein the first and second spring members interconnect the surfboard unit and the base.

3. The surfboard simulator device of claim 2 wherein the base includes a base plate connected to each spring member.

4. The surfboard simulator device of claim 3 wherein the base includes a base platform, wherein the base plate of each spring member is connected to the base platform.

5. The surfboard simulator device of claim 4 wherein the base platform comprises a flat sheet member with a perimeter having a plurality of spaced hand-grip holes.

6. The surfboard simulator device of claim 1 wherein the spring assembly includes at least one pneumatic shock absorber.

7. The surfboard simulator device of claim 1 wherein the spring assembly includes first and second coil springs wherein the elongated surfboard has a longitudinal axis and the coil springs are spatially displaced and mounted to the underside of the surfboard unit along the longitudinal axis of the surfboard.

8. The surfboard simulator of claim 1 wherein the surfboard unit includes a support platform coupled to the surfboard, wherein the interconnection means is connected to the support platform and the base, wherein the surfboard unit is elevated above the base.

* * * * *